US012780579B2

(12) United States Patent
Hoshi et al.

(10) Patent No.: US 12,780,579 B2
(45) Date of Patent: Nov. 3, 2026

(54) CONVEYOR AND IMAGE FORMING APPARATUS

(71) Applicants: Naoki Hoshi, Kanagawa (JP); Tomohiro Egawa, Kanagawa (JP)

(72) Inventors: Naoki Hoshi, Kanagawa (JP); Tomohiro Egawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 193 days.

(21) Appl. No.: 18/645,636

(22) Filed: Apr. 25, 2024

(65) Prior Publication Data

US 2024/0375900 A1 Nov. 14, 2024

(30) Foreign Application Priority Data

May 9, 2023 (JP) ..... 2023-077312
Dec. 25, 2023 (JP) ..... 2023-218011

(51) Int. Cl.
*B65H 9/16* (2006.01)
*B65H 9/00* (2006.01)

(52) U.S. Cl.
CPC ..... *B65H 9/002* (2013.01); *B65H 2301/3613* (2013.01); *B65H 2404/14212* (2013.01); *B65H 2404/532* (2013.01)

(58) Field of Classification Search
CPC . B65H 5/06; B65H 5/36; B65H 29/12; B65H 29/52; B65H 9/002; B65H 9/16; B65H 9/166; B65H 2301/3613; B65H 2515/81; B65H 2404/15212; B65H 2404/611; B65H 2404/19; B65H 2404/5322; B65H 2404/14212
USPC ..... 198/586, 457.02
See application file for complete search history.

(56) References Cited

U.S. PATENT DOCUMENTS 4,953,846 A * 9/1990 Azeta ..... B65H 9/166 271/902
8,919,772 B2 12/2014 Okumura
9,132,989 B2 * 9/2015 Norikane ..... B65H 9/166
9,296,582 B2 * 3/2016 Okumura ..... B65H 9/166
10,124,973 B2 * 11/2018 Hari ..... B65H 5/38
(Continued)

FOREIGN PATENT DOCUMENTS

JP H08-245019 A 9/1996
JP 2018-199572 A 12/2018

OTHER PUBLICATIONS

Extended European Search Report issued Oct. 11, 2024 in European Patent Application No. 24174475.4, 8 pages.
(Continued)

*Primary Examiner* — Leslie A Nicholson, III
(74) *Attorney, Agent, or Firm* — XSENSUS LLP

(57) ABSTRACT

A conveyor includes: a first guide plate including: a first roller shaft; and a first roller having a first hardness and attached to the first roller shaft; and a second guide plate disposed opposite to the first guide plate and including: a second roller shaft; a second roller having a second hardness higher than the first hardness of the first roller and attached to the second roller shaft, wherein parallelism between the first roller shaft and the second roller shaft is variable, and the first guide plate and the second guide plate guide the target, and the first roller and the second roller nips and conveys the target in a conveyance direction.

20 Claims, 5 Drawing Sheets

(56) References Cited

U.S. PATENT DOCUMENTS

| | | | | |
|---|---|---|---|---|
| 10,669,110 | B2 * | 6/2020 | Yamaguchi | G03G 15/6529 |
| 2018/0194581 | A1 | 7/2018 | Matsumoto | |
| 2018/0314190 | A1 | 11/2018 | Yin et al. | |
| 2019/0161299 | A1 | 5/2019 | Egawa et al. | |
| 2019/0161301 | A1 | 5/2019 | Maeyama et al. | |
| 2019/0241385 | A1 | 8/2019 | Kaneko et al. | |
| 2019/0276258 | A1 | 9/2019 | Egawa et al. | |
| 2019/0283998 | A1 | 9/2019 | Uchida et al. | |
| 2020/0156889 | A1 | 5/2020 | Egawa | |
| 2022/0124212 | A1 | 4/2022 | Egawa | |

OTHER PUBLICATIONS

Yoichiro Iizuka, et al., "Lateral Paper Motion Characteristics of a Paper Transfer Mechanism", The Japan Society of Mechanical Engineers, NII-Electronic Library Service, Sep. 2006, pp. 605-606, including English Abstract.

* cited by examiner

CONVEYOR AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2023-077312, filed on May 9, 2023, in the Japan Patent Office, and Japanese Patent Application No. 2023-218011, filed on Dec. 25, 2023, in the Japan Patent Office, the entire disclosure of which are hereby incorporated by reference herein.

BACKGROUND

Technical Field

The present embodiment relates to a conveyor and an image forming apparatus, and particularly relates to a conveyor including an inclinable roller shaft and an image forming apparatus including the conveyor.

Related Art

In a registration technique for a conveyor that conveys cut sheets, the position of a sheet is automatically corrected for drawing an image at a desired position on the sheet. In the registration technique, one (inclination roller) of a pair of rollers for nipping and conveying the sheet is inclined. The inclination roller, however, has a limited inclination range that restricts a range of automatic correction.

In order to conserve paper resources, an image forming apparatus performs double-sided print in which both sides of a sheet are subjected to print. For the double-sided print, a conveyance path is long for reversing the sheet in a double-sided conveyance path. In particular, an apparatus like an inkjet printer that performs sheet drying and sheet cooling after image formation is large and long in size for a drying process and a cooling process.

In such dry process and cooling process, not roller conveyance but belt conveyance is often performed. Thus, the positional shift (amount of shift) of the sheet increases as the sheet is conveyed downstream in the conveyance direction. The positional shift of the sheet is affected by factors different in individual conveyors, such as the dimensional tolerance of various components of the conveyors and the parallelism of housings of the conveyors. Therefore, the positional shift of the sheet exceeds an allowance range of automatic correction in such the registration technique as described above.

SUMMARY

In an aspect of the present disclosure, a conveyor includes: a first guide plate including: a first roller shaft; and a first roller having a first hardness and attached to the first roller shaft; and a second guide plate disposed opposite to the first guide plate and including: a second roller shaft; a second roller having a second hardness higher than the first hardness of the first roller and attached to the second roller shaft, wherein parallelism between the first roller shaft and the second roller shaft is variable, and the first guide plate and the second guide plate guide the target, and the first roller and the second roller nips and conveys the target in a conveyance direction.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
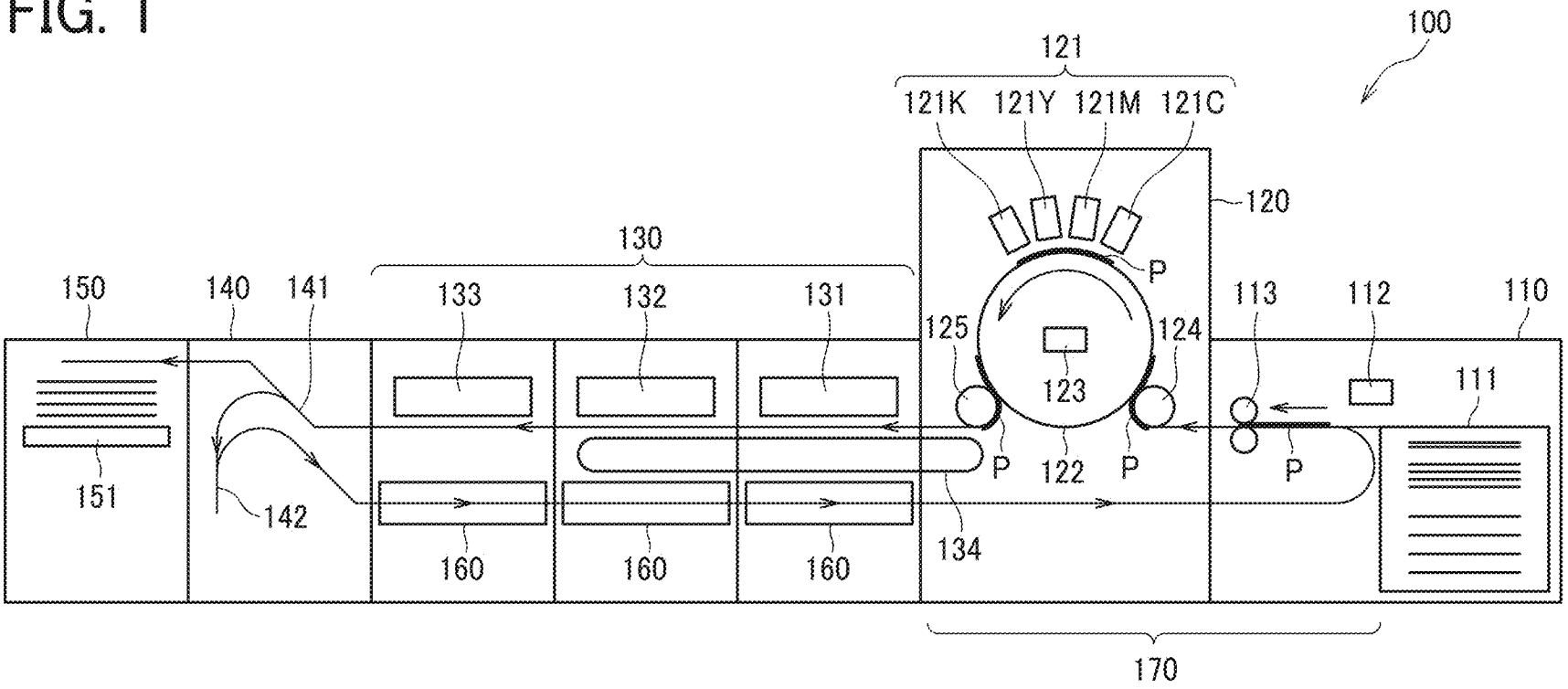
FIG. 1 is a schematic configuration view of an image forming apparatus according to an embodiment of the present embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Image Forming Apparatus

An embodiment of the present embodiment will be described below with reference to the accompanying drawings. FIG. 1 is a schematic configuration view of an inkjet printer 100 as an image forming apparatus large in size. The inkjet printer 100 mainly includes a sheet feeder 110, an image former 120, a dryer/cooler 130, a sheet reverser 140, a sheet ejector 150, and a positional adjustment mechanism 160.

A sheet P in the sheet feeder 110 is conveyed to the sheet ejector 150 by a conveyor with a roller and a belt. Note that "image formation" used in the following description means not only giving an image having a meaning such as a character and a figure to a medium, but also giving an image having no meaning such as a pattern to a medium.

In the inkjet printer 100, an image is formed, by the image former 120, on the sheet P that is a recording material as a sheet material fed from the sheet feeder 110, with ink as a liquid for image formation. Then, the ink attached on the sheet P is dried by the dryer/cooler 130 before the sheet is ejected to the sheet ejector 150.

Sheet Feeder

The sheet feeder 110 mainly includes a sheet feeding tray 111 for stacking a plurality of sheets P thereon, a feeding device 112 that one-by-one separates the sheets P from the sheet feeding tray 111 to send the separated sheet P, and a pair of registration rollers 113 that sends the sheet P into the image former 120. Any feeding device such as a device with a roller or a rolling element or such as a device using air suction may be used as the feeding device 112.

After the leading end of the sheet P fed from the sheet feeding tray 111 by the feeding device 112 reaches the pair of registration rollers 113, the pair of registration rollers 113 is driven at a predetermined timing to feed the sheet P to the image former 120. Note that, in the present embodiment, the sheet feeder 110 is not limited in configuration as long as the sheet feeder 110 feeds a sheet P to the image former 120.

Image Former

The image former 120 mainly includes an ink discharger 121, a sheet carrying drum 122, a suction device 123, a reception barrel 124, and a delivery barrel 125. The reception barrel 124 receives the fed sheet P. The sheet carrying drum 122 conveys the sheet P conveyed by the reception barrel 124 with carrying the sheet P on the outer peripheral face of the sheet carrying drum 122. The ink discharger 121 discharges ink toward the sheet P carried by the sheet carrying drum 122. The delivery barrel 125 delivers the sheet P conveyed by the sheet carrying drum 122 to the dryer/cooler 130.

The leading end of the sheet P conveyed from the sheet feeder 110 to the image former 120 is gripped by a sheet gripper provided on the surface of the reception barrel 124. The sheet P is conveyed along with the surface movement of the reception barrel 124. The sheet P conveyed by the reception barrel 124 is delivered to the sheet carrying drum 122 at a position opposed to the sheet carrying drum 122.

A sheet gripper is also provided on the surface of the sheet carrying drum 122, and the leading end of the sheet P is gripped by the sheet gripper. The surface of the sheet carrying drum 122 has a plurality of suction holes dispersed.

In each suction hole, an intake airflow toward the inside of the sheet carrying drum 122 is generated by the suction device 123. The sheet P delivered from the reception barrel 124 to the sheet carrying drum 122 is attracted, with the leading end gripped by the sheet gripper, to the surface of the sheet carrying drum 122 by the intake airflow. The sheet P is conveyed along with the surface movement of the sheet carrying drum 122.

The ink discharger 121 of the present embodiment discharges inks of four colors of cyan (C), magenta (M), yellow (Y), and black (K) to form an image. The ink discharger 121 includes liquid discharge heads 121C, 121M, 121Y, and 121K one-to-one corresponding to the inks.

The liquid discharge heads 121C, 121M, 121Y, and 121K are not limited in configuration as long as the liquid discharge heads 121C, 121M, 121Y, and 121K discharge liquid, and thus any configuration is adoptable. A liquid discharge head that discharges special ink such as white, gold, or silver may be provided, or a liquid discharge head that discharges a liquid such as a surface coating liquid that does not form an image may be provided.

The discharge operation of each of the liquid discharge heads 121C, 121M, 121Y, 121K of the ink discharger 121 is controlled on the basis of a drive signal corresponding to image information. In passing of the sheet P carried on the sheet carrying drum 122 through a region facing the ink discharger 121, the respective color inks are discharged from the liquid discharge heads 121C, 121M, 121Y, and 121K to form an image corresponding to the image information. Note that, in the present embodiment, the image former 120 is not limited in configuration as long as the image former 120 forms an image by attaching liquid onto a sheet P.

Dryer/Cooler

The dryer/cooler 130 mainly includes drying/cooling mechanisms 131, 132, and 133 for drying and cooling such an ink as described above that is attached on the sheet P by the image former 120, and a conveyance mechanism for conveying the sheet P conveyed from the image former 120 by a belt conveyor. The sheet P conveyed from the image former 120 is received by the conveyance mechanism. Then, the sheet P is conveyed so as to pass the drying/cooling mechanisms 131, 132, and 133 in order, and delivered to the sheet ejector 150.

In passing of the sheet P through the drying/cooling mechanisms 131, 132, and 133, the ink on the sheet P is subjected to drying and cooling. As a result, liquid components such as moisture in the ink on the sheet P evaporate, and the ink adheres to the sheet P. Further, curling of the sheet P is suppressed by the cooling.

Sheet Reverser

The sheet reverser 140 includes a bifurcating part 141 and a switchback part 142. A sheet P for single-sided print passes the bifurcating part 141 and is conveyed to the sheet ejector 150. A sheet P for double-sided print is conveyed downward from the bifurcating part 141. The sheet P for double-sided print is reversed through the switchback part 142, and then conveyed to the image former 120 again.

On the way of the conveyance from the switchback part 142 to the image former 120, the positional adjustment mechanism including three units of positional adjustment mechanisms 160 is disposed. The positional adjustment mechanisms 160 are located in succession in the conveyance direction of the sheet P. The positional adjustment mechanisms 160 are disposed below the dryer/cooler 130. The positional adjustment mechanisms 160 each include a plurality of roller shafts for conveying a sheet P. Any of the roller shafts is inclined to correct the amount of shift of the sheet P.

The positional adjustment mechanisms 160 are provided in a conveyance path through which a sheet P passes in double-sided print. Thus, the conveyance of the first face of the sheet P in single-sided print smaller in the amount of shift is not affected and the conveyance state of the second face of the sheet P in double-sided print larger in the amount of shift can be improved. The positional adjustment mechanisms 160 perform positional adjustment across the plurality of units. Thus, a decrease in the inclination angle of each roller shaft of each positional adjustment mechanism 160 results in suppression of the stress of the sheet P between an inclined roller shaft and a non-inclined roller shaft, and a large positional correction effect can be obtained.

Sheet Ejector

The sheet ejector 150 mainly includes a sheet ejection tray 151 for stacking a plurality of sheets P thereon. The sheet P conveyed through the sheet reverser 140 is sequentially stacked and kept on the sheet ejection tray 151. Note that, in the present embodiment, the sheet ejector 150 is not limited in configuration as long as the sheet ejector 150 ejects a sheet P.

Other Functional Units

Other functional units can be appropriately added to the inkjet printer 100 of the present embodiment. For example, a pre-processing unit that performs pre-processing for image formation can be added between the sheet feeder 110 and the image former 120. Examples of the pre-processing unit include a unit that performs a treatment-liquid application to apply a treatment liquid onto a sheet P and make the treatment liquid react with the ink for reduction of bleeding. However, the details of the pre-processing are not particularly limited.

Further, a post-processing unit that performs post-processing for image formation can be added before the sheet ejector 150.

Examples of the post-processing unit include a unit that performs binding a plurality of sheets with images formed thereon and a correction mechanism for correcting sheet deformation. However, the details of the post-processing are not particularly limited.

Positional Adjustment Mechanism

Figure 2A:
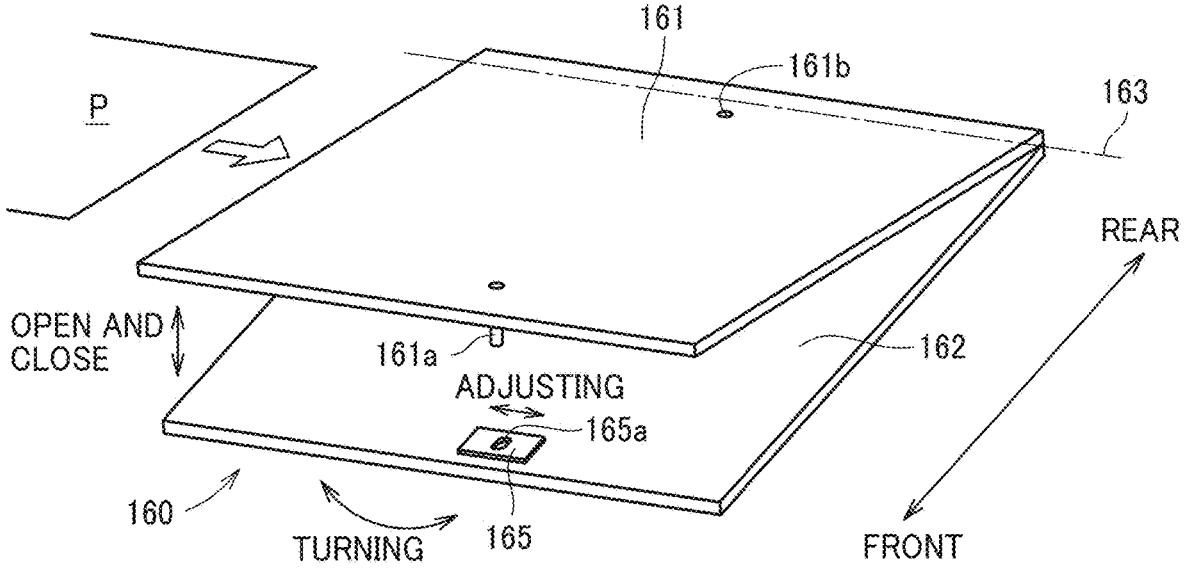
FIG. 2A is a perspective view of the basic configuration of a positional adjustment mechanism included in a conveyor according to the embodiment of the present embodiment.
Figure 2B:
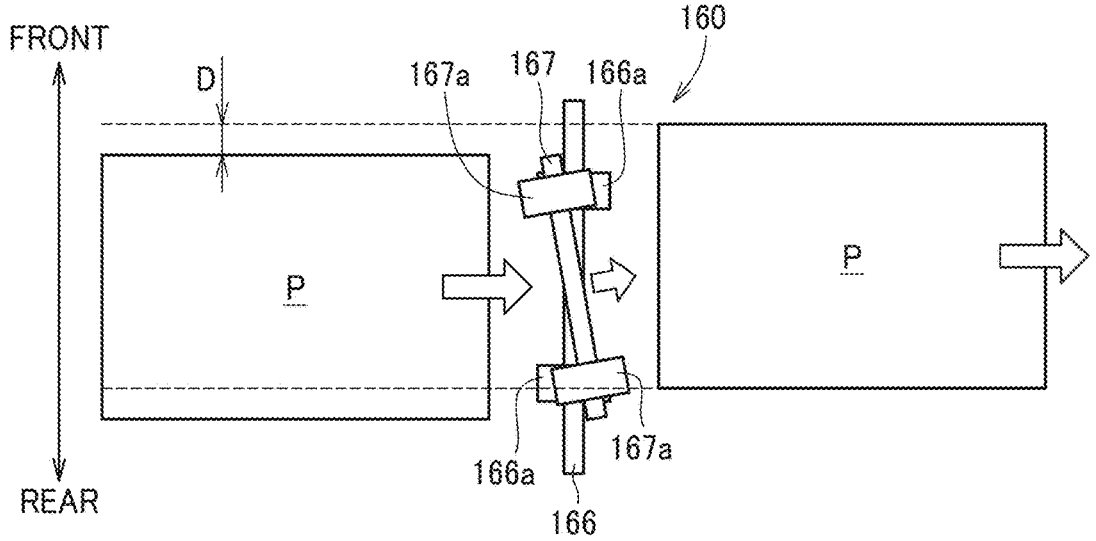
FIG. 2B is a bottom view of the positional adjustment mechanism in FIG. 2A.

FIGS. 2A and 2B illustrate the basic configuration of such a positional adjustment mechanism 160 as described above that is included in the conveyor of the present embodiment. The positional adjustment mechanism 160 includes a pair of a first guide plate 161 and a second guide plate 162. The upper first guide plate 161 serves as a secured guide plate 161. The lower second guide plate 162 serves as a movable guide plate 162.

The secured guide plate 161 and the movable guide plate 162 convey a sheet P from the left side to the right side in FIG. 2A with guiding the upper and lower faces of the sheet P. The secured guide plate 161 is disposed to be horizontally secured. On the other hand, the movable guide plate 162 is disposed openably with respect to the secured guide plate 161.

That is, an end on the rear side of the secured guide plate 161 and an end on the rear side of the movable guide plate 162 are coupled through a hinge shaft 163. The hinge shaft 163 is disposed in parallel to the conveyance direction of the sheet P. The other end on the front side of the movable guide plate 162 opposite the hinge shaft 163 is turnable in the up-and-down direction about the hinge shaft 163.

The hinge shaft 163 has an end and the other end in the longitudinal direction. The end and the other end can be supported by a left-and-right pair of bearings provided on the secured guide plate 161. The other end on the front side of the movable guide plate 162 is engageable and lockable with the other end on the front side of the secured guide plate 161 by a locking means.

As illustrated in FIG. 2B, the secured guide plate 161 includes a first roller shaft 166, and the movable guide plate 162 includes a second roller shaft 167. FIG. 2B is a bottom view of the positional adjustment mechanism 160 with the secured guide plate 161 and the movable guide plate 162 in FIG. 2A omitted.

The first roller shaft 166 has first roller members 166*a* attached thereto. The second roller shaft 167 has second roller members 167*a* attached thereto. The sheet P is sent between the first roller members 166*a* attached to the first roller shaft 166 and the second roller members 167*a* attached to the second roller shaft 167. Then, the sheet P is nipped and conveyed by the first roller members 166*a* and the second roller members 167*a*. At least one of the first roller shaft 166 and the second roller shaft 167 is coupled to a driving means such that the at least one can be driven to rotate.

The first roller members 166*a* and the second roller members 167*a* can be made identical in diameter and length with an elastic body made of, for example, synthetic rubber or elastomer. However, the first roller members 166*a* and the second roller members 167*a* are different in hardness (surface hardness).

The second roller members 167*a* of the second roller shaft 167 that has a variable inclination angle are higher in hardness than the first roller members 166*a*. This is because, as disclosed in Non-Patent Literature 1, the conveyance direction of the sheet P is affected by a roller member relatively higher in hardness.

The surface hardness of the first roller members 166*a* and the second roller members 167*a* can be measured with, for example, Asker Durometer Type C or a durometer. For such a first roller member 166*a*, for example, used can be a low hardness elastomer (olefinic elastomer such as styrene butadiene styrene (SBS), styrene isoprene styrene (SIS), or SEDS) having, for example, a durometer-based hardness of 20 to 50. For such a second roller member 167*a*, for example, used can be a slightly-high hardness elastomer (ester-based, urethane-based, or aramide-based) or a slightly-high hardness thermoplastic resin such as polypropylene or acrylonitrile butadiene styrene (ABS) within the range of the durometer-based hardness of 65 to 80 such as the durometer-based hardness of 74.

In the positional adjustment mechanism 160, the movable guide plate 162 including the roller shafts 167 is openable with respect to the secured guide plate 161 as indicated by a double arrow in FIG. 2A, and the movable guide plate 162 is also turnable as described later. With this arrangement, as illustrated in FIG. 2B, the roller shaft 167 is inclined such that the conveyance direction of the sheet P is changed to a direction indicated by open arrows in FIG. 2B. That is, in a case where the sheet P conveyed from the left side in FIG. 2B is shifted downward by D from the normal position, the amount of shift D is canceled.

The end on the rear side of the secured guide plate 161 has a lower face from which a pivot pin 161*b* protrudes, and the pivot pin 161*b* is located near the hinge shaft 163. The end on the rear side of the secured guide plate 161 and the end on the rear side of the movable guide plate 162 are turnably coupled through the pivot pin 161*b*.

The other end on the front side of the secured guide plate 161 has a lower face from which an engagement pin 161*a* protrudes. The engagement pin 161*a* is located at a position opposite the pivot pin 161*b*. The other end on the front side of the secured guide plate 161 and the other end on the front side of the movable guide plate 162 can be engaged through the engagement pin 161*a*.

Figure 3A:
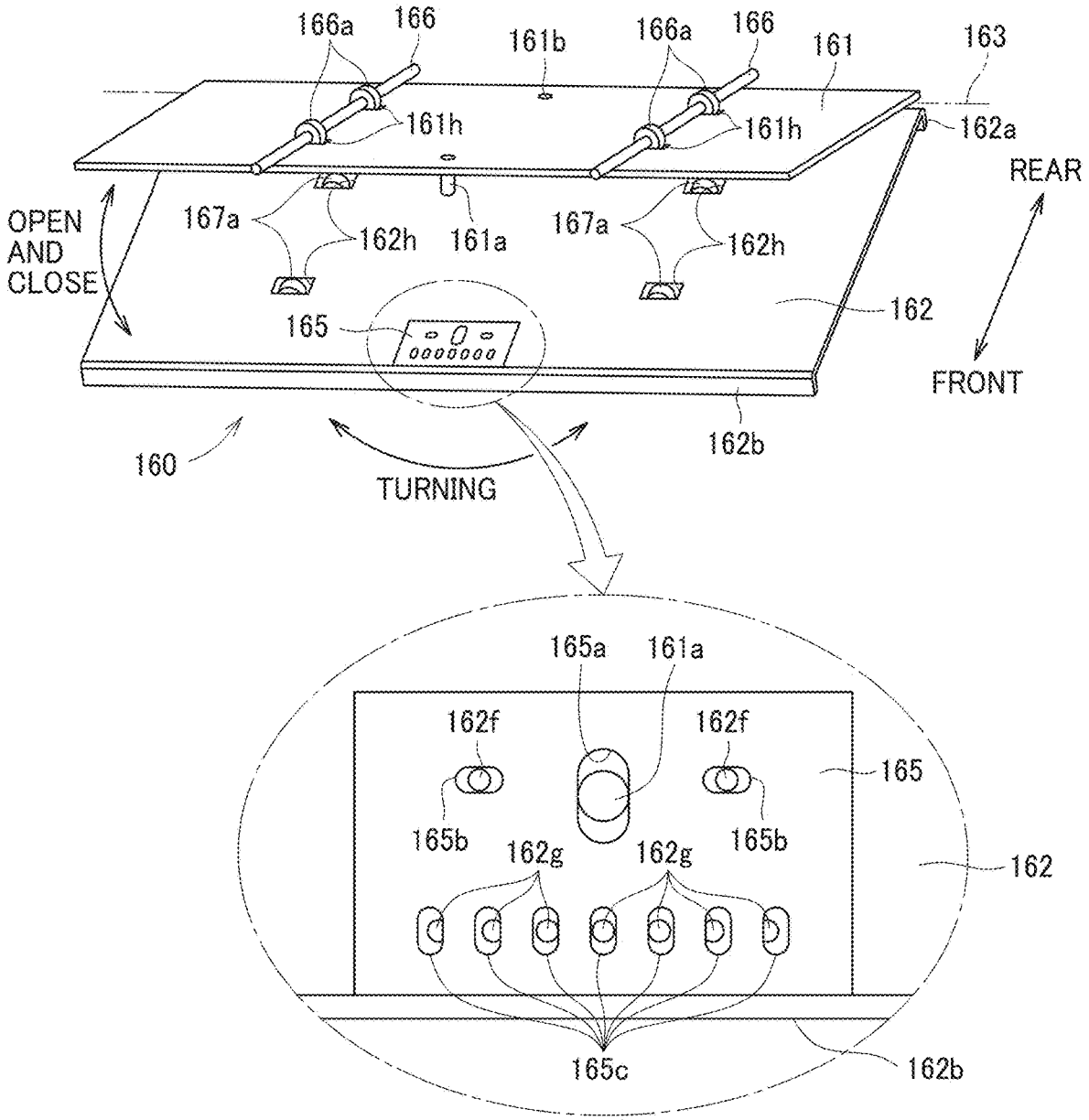
FIG. 3A is a perspective view of the positional adjustment mechanism.
Figure 3B:
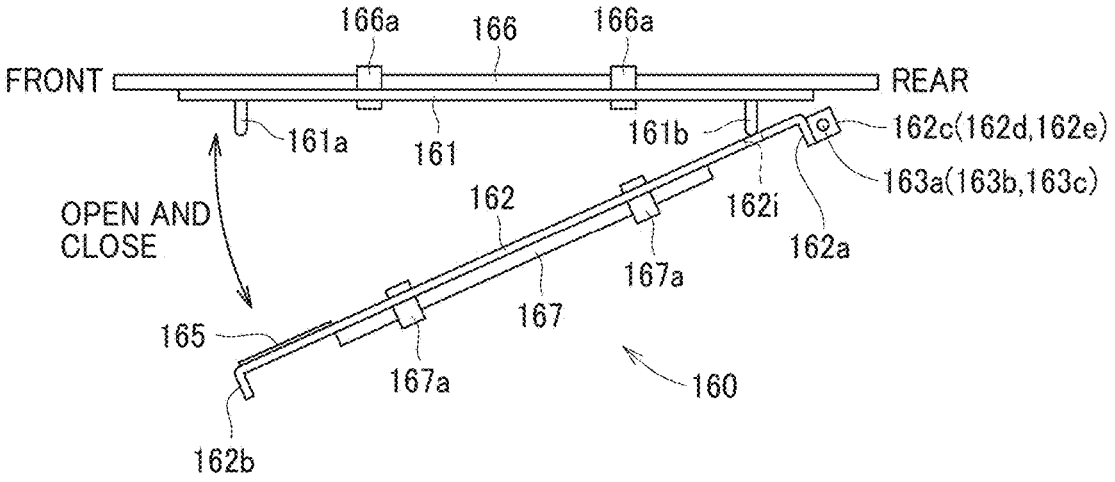
FIG. 3B is a side view of the positional adjustment mechanism with a movable guide plate open, viewed in a conveyance direction.
Figure 3C:
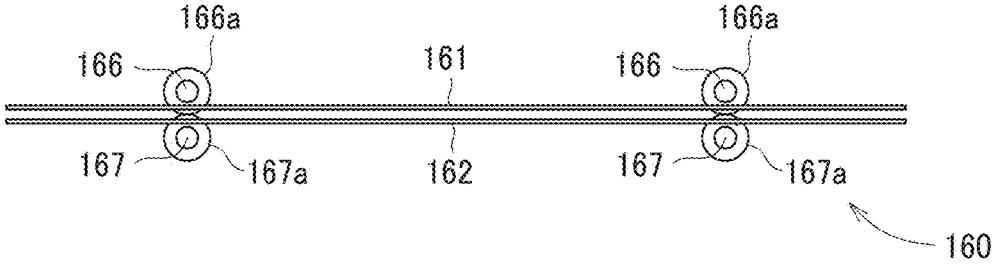
FIG. 3C is a side view of roller shafts of the positional adjustment mechanism before variation of the parallelism between the roller shafts.
Figure 3D:
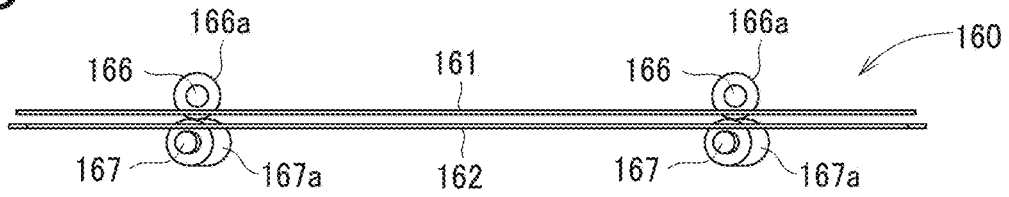
FIG. 3D is a side view of the roller shafts of the positional adjustment mechanism after variation of the parallelism between the roller shafts.

The other end on the front side of the movable guide plate 162 has an upper face on which an adjustment plate 165 is disposed. The adjustment plate 165 as an engagement member is disposed so as to be engaged with the engagement pin 161*a*. The adjustment plate 165 has an engagement hole 165*a*. The engagement pin 161*a* is fit into the engagement hole 165*a* of the adjustment plate 165 such that the relative positional relationship between the secured guide plate 161 and the movable guide plate 162 is kept constant. As will be described later with reference to FIG. 3A, the adjustment plate 165 is attachable to the movable guide plate 162 such that the positional adjustment of the adjustment plate 165 can be made in the left-and-right direction (conveyance direction) in FIG. 3A.

FIGS. 3A to 3D illustrate an embodiment in which the secured guide plate 161 is provided with a left-and-right pair of roller shafts 166 and the movable guide plate 162 is provided with a left-and-right pair of roller shafts 167. Because the sheet P is conveyed by the left-and-right pair of roller shafts 166 and the left-and-right pair of the roller shafts 167, the sheet conveyance force and the shift adjustment force are improved.

The respective inclination angles of the two roller shafts 167 can be adjusted together by adjustment of the movable guide plate 162. The secured guide plate 161 may be provided with three or more roller shafts and the movable guide plate 162 may be provided with three or more roller shafts.

The secured guide plate 161 is provided with each rectangular cutout hole 161*h* through which the corresponding first roller member 166*a* of each first roller shaft 166 protrudes inward the secured guide plate 161. The movable guide plate 162 is provided with each rectangular cutout hole 162*h* through which the corresponding second roller member 167*a* of each second roller shaft 167 protrudes inward the movable guide plate 162. Part of the outer peripheral face of the first roller member 166*a* protrudes inward the secured guide plate 161 through the cutout hole 161*h*. Part of the outer peripheral face of the second roller member 167*a* protrudes inward the movable guide plate 162 through the cutout hole 162*h*. The roller shafts 166 and 167 are rotatably supported by bearings disposed outside the secured guide plate 161 and the movable guide plate 162.

The movable guide plate 162 has a bent part 162*a* and a bent part 162*b* each having an L-shape. The bent part 162*a* and the bent part 162*b* are located, respectively, at the end on the rear side and the other end on the front side of the movable guide plate 162. The bent parts 162*a* and 162*b* improve the rigidity and strength of the movable guide plate 162.

Figure 4:
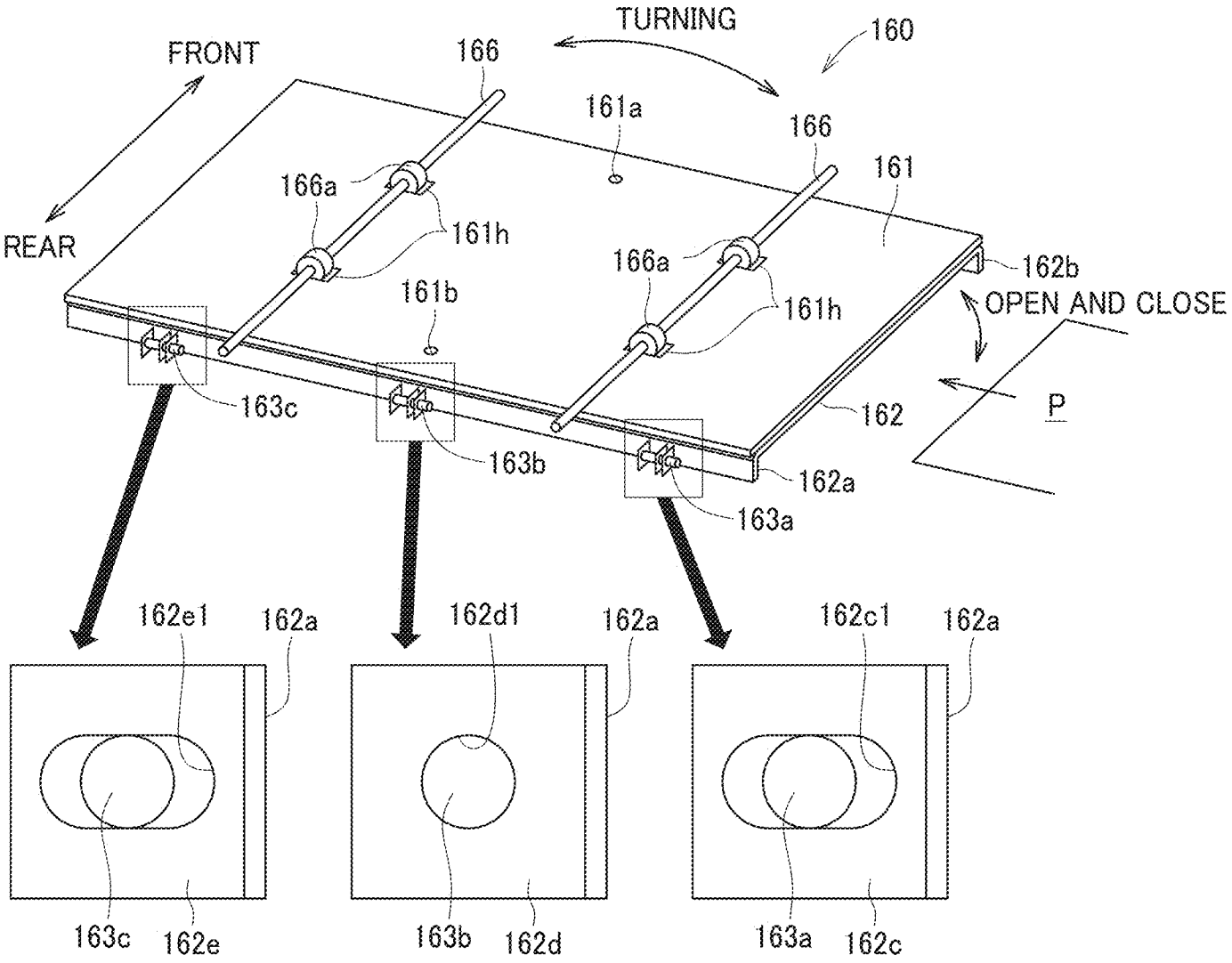
FIG. 4 is a perspective of the positional adjustment mechanism with the movable guide plate closed.

As illustrated in FIG. 4, the bent part 162*a* at the end on the rear side is integrally provided with three brackets 162*c*, 162*d*, and 162*e*. These three brackets 162*c*, 162*d*, and 162*e* are disposed at equal intervals in the conveyance direction, for insertion and support of three hinge shafts 163*a*, 163*b*, and 163*c*.

The three hinge shafts 163*a*, 163*b*, and 163*c* are disposed in a straight line in the conveyance direction. The three hinge shafts 163*a*, 163*b*, and 163*c* are a first hinge shaft 163*a*, a second hinge shaft 163*b*, and a third hinge shaft 163*c*, respectively, from the upstream side in the conveyance direction.

The brackets 162*c*, 162*d*, and 162*e*, respectively, have receiving holes 162*c*1, 162*d*1, and 162*e*1 through which the corresponding hinge shafts 163*a*, 163*b*, and 163*c* are inserted. The receiving holes 162*c*1 and 162*e*1 at both ends of the bent part 162*a* are long holes extending in the conveyance direction.

On the other hand, the central receiving hole 162*d*1 has a circular shape through which the second hinge shaft 163*b* can be inserted without looseness. Therefore, when the movable guide plate 162 turns (horizontally turns) in a direction indicated by a double arrow in FIG. 4 about the pivot pin 161*b* inserted in a pin hole 162*i* in FIG. 3B near the second hinge shaft 163*b*, the first hinge shaft 163*a* and the third hinge shaft 163*c* are movable in the left-and-right direction in the receiving holes 162*c*1 and 162*e*1 at both ends of the bent part 162*a*. That is, the receiving hole 162*c*1 and the receiving hole 162*e*1 in long hole shape each have looseness allowing the movable guide plate 162 to turn (horizontally turn) in the arrow direction of FIG. 4 about the pivot pin 161*b*.

Adjustment Plate

The engagement hole 165*a* of the adjustment plate 165 is a long hole extending in a direction perpendicular to the conveyance direction or the hinge shaft 163. This is because the engagement pin 161*a* is smoothly inserted into the engagement hole 165*a* of the adjustment plate 165. However, there is almost no looseness between the engagement pin 161*a* and the engagement hole 165*a* in the left-and-right direction (conveyance direction) in FIG. 3A.

An adjustment hole 165*b* and another adjustment hole 165*b* are provided, respectively, on the left side and the right side of the engagement hole 165*a* of the adjustment plate 165. The adjustment hole 165*b* and the other adjustment hole 165*b* are paired. At the other end on the front side of the movable guide plate 162, a screw hole 162*f* and another screw hole 162*f* are provided at positions one-to-one corresponding to the adjustment hole 165*b* and the other adjustment hole 165*b*. The screw hole 162*f* and the other screw hole 162*f* are paired.

A plurality of (seven in the illustrated example) adjustment holes 165*c* are provided in front of the engagement hole 165*a* of the adjustment plate 165 at equal intervals in the conveyance direction. The other end on the front side of the movable guide plate 162 has a plurality of screw holes 162*g* one-to-one corresponding to the plurality of adjustment holes 165*c*.

The pitch of the screw holes 162*g* is slightly shifted from the pitch of the adjustment holes 165*c*. The adjustment plate 165 can be screwed to the movable guide plate 162 with the central adjustment hole 165*c* among the plurality of adjustment holes 165*c* aligned with any one of the screw holes 162*g*.

In the illustrated example, the central adjustment hole 165*c* is aligned with the central screw hole 162*g*. The adjustment plate 165 is screwed to the movable guide plate 162 with this alignment, so that the movable guide plate 162 has a turning angle of 0 with respect to the secured guide plate 161.

Any of left or right screw holes 162*g* is selected as the screw hole 162*g* with which the central adjustment hole 165*c* is aligned. The adjustment plate 165 is screwed with the central adjustment hole 165*c* aligned with the selected screw hole 162*g*, so that the movable guide plate 162 can have a positive turning angle or a negative turning angle with respect to the secured guide plate 161. At this time, the positive or negative alignment of the adjustment plate 165 can be easily performed due to the shape of the screw hole 162*g* viewed through the corresponding adjustment hole 165*c*. Therefore, the movable guide plate 162 and the inclination angle of such a second roller shaft 167 as described above can be easily fixed to target values.

Regarding the positional adjustment, the conveyor and the positional adjustment mechanism of the present embodiment have the configurations as described above. As described above, in an image forming apparatus having a long conveyance path, the positional shift (amount of shift) of a sheet may be increased and may exceed an allowance range of automatic correction. The positional shift of the sheet is affected by factors different in individual conveyors.

Therefore, the above-described positional adjustment of the movable guide plate 162 and the adjustment plate 165 can be performed so as to cancel the amount of shift corresponding to the amount of shift acquired by experimental conveyance of a sheet P. Specifically, measured is the amount of shift of a specific sheet P when the specific sheet P started to be conveyed from the sheet feeder 110 returns to the feeding device 112 again through the sheet reverser 140. Then, the inclination angle of the roller shaft 167 is determined by the positional adjustment of the movable guide plate 162 and the adjustment plate 165 such that the amount of shift becomes 0 by the three positional adjustment mechanisms 160.

All the roller shafts 167 of the three positional adjustment mechanisms 160 are each set to have a certain inclination angle. With this arrangement, the amount of shift correction for the sheet P is made uniform by each positional adjustment mechanism 160, resulting in improvement in accuracy of the positional adjustment. Further, the shift correction is performed in stages, resulting in suppression of damage to the sheet P.

The inclination angles of the roller shafts 167 of the three positional adjustment mechanisms 160 are not necessarily required to be uniform to a certain inclination angle. The most upstream roller shaft 167 through which the sheet P passes may have a smallest inclination angle and a more downstream roller shaft 167 may have a larger inclination angle.

This arrangement results in a smooth shift correction for a sheet P particularly in high-speed conveyance. Such a positional adjustment mechanism 160 as described above can be added easily and at low cost in the conveyance direction of the sheet P. Thus, the cancel adjustment for the amount of shift can be performed regardless of the level of the amount of shift.

The positional adjustment mechanism 160 looseness a role of coarse adjustment in tendency of a sheet positional shift different in individual conveyors. After adjustment is performed at the time of assembly or installation of a conveyor, regular adjustment is basically eliminated. However, in accordance with a change in the amount of shift to be canceled due to, for example, change of the sheet P to be used for print, the movable guide plate 162 is opened from the front side of the conveyor. As a result, the positions of the movable guide plate 162 and the adjustment plate 165 can be easily readjusted.

A conveyor includes: a first guide plate (161) including: a first roller shaft; and a first roller having a first hardness and attached to the first roller shaft; and a second guide plate (162) disposed opposite to the first guide plate (161) and including: a second roller shaft; and a second roller having a second hardness higher than the first hardness of the first roller and attached to the second roller shaft, wherein parallelism between the first roller shaft and the second roller shaft is variable, and the first guide plate (161) and the second guide plate (162) guide the target, and the first roller and the second roller nips and conveys the target in a conveyance direction.

The first guide plate (161) is fixed, and the second guide plate (162) is movable relative to the first guide plate (161) to vary the parallelism between the first roller shaft and the second roller shaft.

The second guide plate (162) is openably closable with respect to the first guide plate (161).

The conveyor includes a hinge shaft (163) to couple one end of the first guide plate (161) to one end of the second guide plate (162), wherein another end of the second guide plate (162) is rotatable with respect to another end of the first guide plate (161) about the hinge shaft (163).

The hinge shaft (163) is parallel to the conveyance direction.

One of said another end of the first guide plate (161) or said another end of the second guide plate (162) has an adjustment plate (165) having an engagement hole (165*a*); and another of said another end of the first guide plate (161) or said another end of the second guide plate (162) has an engagement pin (161*a*) fit into the engagement hole (165*a*).

The adjustment plate (165) is attachable to said another end of the second guide plate (162) at variable positions to vary a position of the second guide plate (162) with respect to the first guide plate (161).

The hinge shaft (163) has a looseness to vary the position of the second guide plate (162) with respect to the first guide plate (161).

The hinge shaft (163) includes: a first hinge shaft; a second hinge shaft; and a third hinge shaft, disposed in an order from an upstream side to a downstream side in the conveyance direction of the target, and each of the first hinge shaft and the third hinge shaft has a long hole to vary the position of the second guide plate (162) with respect to the first guide plate (161).

The conveyor includes a pivot pin (161*b*) through which the one end of the first guide plate (161) and the one end of the second guide plate (162) are coupled in vicinity of the second hinge shaft, and the second guide plate (162) is turnable with respect to the first guide plate (161) about the pivot pin (161*b*).

The present embodiment has been specifically described on the basis of the embodiments. The present embodiment, however, is not limited to the embodiments, and thus it goes without saying that various modifications can be made within the scope of the technical idea described in the claims. For example, in the embodiments, the movable guide plate 162 is disposed openably and turnably with respect to the secured guide plate 161. The movable guide plate 162, however, is not necessarily required to be movable. The parallelism between a first roller shaft 166 including first roller members 166*a* lower in hardness and a second roller shaft 167 including second roller members 167*a* higher in hardness may be variable.

In the embodiments, the sheet P has been described as a conveyance target. The conveyance target, however, is not limited to the sheet P. The conveyance target also includes an overhead projector (OHP) sheet, fabric, a metal sheet, a plastic film, and a prepreg sheet that results from impregnation of carbon fibers with a resin in advance. A medium, recording paper, and a recording sheet to which a developer or ink can be attached are all included in the "conveyance target". In addition to a plain sheet, the "sheet" includes thick paper, a postcard, an envelope, thin paper, coated paper (e.g., a coated sheet and an art sheet), and tracing paper.

Supplementary Note

Preferred aspects of the present embodiment will be described below.

Aspect 1

According to Aspect 1, a conveyor includes: a first guide plate including a first roller shaft and a first roller member attached to the first roller shaft; and a second guide plate including a second roller shaft and a second roller member attached to the second roller shaft, the second guide plate being disposed opposite the first guide plate, in which the second roller member is higher in hardness than the first roller member, parallelism between the first roller shaft and the second roller shaft is variable, and the conveyor is configured to convey a conveyance target with the first roller member and the second roller member nipping the conveyance target and with the first guide plate and the second guide plate guiding the conveyance target.

Aspect 2

According to Aspect 2, in the conveyor of Aspect 1, the first guide plate includes a secured guide plate, the second guide plate includes a movable guide plate, and the movable guide plate is variable with respect to the secured guide plate such that the parallelism between the first roller shaft and the second roller shaft varies.

Aspect 3

According to Aspect 3, in the conveyor of Aspect 2, the movable guide plate is openable with respect to the secured guide plate.

Aspect 4

According to Aspect 4, the conveyor of Aspect 3 further includes a hinge shaft, in which an end of the secured guide plate and an end of the movable guide plate are coupled through the hinge shaft such that the movable guide plate is openable with respect to the secured guide plate about the hinge shaft.

Aspect 5

According to Aspect 5, in the conveyor of Aspect 4, the hinge shaft is disposed in parallel to a conveyance direction of the conveyance target.

Aspect 6

According to Aspect 6, the conveyor of Aspect 5 further includes an engagement member disposed such that the secured guide plate and the movable guide plate are engaged together at another end of the secured guide plate and another end of the movable guide plate that are located opposite to the hinge shaft.

Aspect 7

According to Aspect 7, in the conveyor of Aspect 6, the engagement member is attachable to said another end of the movable guide plate at any of a plurality of positions allowing the movable guide plate to vary with respect to the secured guide plate.

Aspect 8

According to Aspect 8, in the conveyor of Aspect 7, the hinge shaft has looseness that allows the movable guide plate to vary.

Aspect 9

According to Aspect 9, in the conveyor of Aspect 8, the hinge shaft includes a first hinge shaft, a second hinge shaft, and a third hinge shaft disposed from an upstream side to a downstream side in the conveyance direction of the conveyance target, and the first hinge shaft and the third hinge shaft each have the looseness.

Aspect 10

According to Aspect 10, the conveyor of Aspect 9 further includes a pivot pin, in which the end of the secured guide plate and the end of the movable guide plate are coupled through the pivot pin near the second hinge shaft, and the movable guide plate is turnable with respect to the secured guide plate about the pivot pin.

Aspect 11

According to Aspect 11, an image forming apparatus includes the conveyor according to any one of Aspect 1 to Aspect 10.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A conveyor comprising:
a first guide plate including:
a first roller shaft; and
a first roller having a first hardness and attached to the first roller shaft; and
a second guide plate disposed opposite to the first guide plate and including:
a second roller shaft; and
a second roller having a second hardness higher than the first hardness of the first roller and attached to the second roller shaft,
wherein parallelism between the first roller shaft and the second roller shaft is variable, and
the first guide plate and the second guide plate guide a target, and
the first roller and the second roller nip and convey the target in a conveyance direction,
wherein one of the first guide plate or the second guide plate has an adjustment plate having an engagement hole; and
another of the first guide plate or the second guide plate has an engagement pin fit into the engagement hole to vary the position.

2. The conveyor according to claim 1,
wherein the first guide plate is fixed, and
the second guide plate is movable relative to the first guide plate to vary the parallelism between the first roller shaft and the second roller shaft.

3. The conveyor according to claim 2,
wherein the second guide plate is openably closable with respect to the first guide plate.

4. The conveyor according to claim 3, further comprising a hinge shaft to couple one end of the first guide plate to one end of the second guide plate,
wherein another end of the second guide plate is rotatable with respect to another end of the first guide plate about the hinge shaft.

5. The conveyor according to claim 4,
wherein the hinge shaft is parallel to the conveyance direction.

6. An image forming apparatus comprising:
the conveyor according to claim 1; and
an image former including an ink discharger that discharges ink towards a sheet.

7. The image forming apparatus according to claim 6, includes a dryer or a cooler, wherein the second guide plate is disposed on the dryer or the cooler.

8. The image forming apparatus according to claim 7, wherein the dryer or the cooler has another passage to convey the target in the direction opposite to the conveyance direction.

9. The conveyor according to claim 1, wherein the adjustment plate is attachable to said another end of the second guide plate at variable positions to vary the position of the second guide plate with respect to the first guide plate.

10. The conveyor according to claim 9, further comprising a hinge shaft to couple one end of the first guide plate to one end of the second guide plate, wherein another end of the second guide plate is rotatable with respect to another end of the first guide plate about the hinge shaft.

11. The conveyor according to claim 9, wherein the first guide plate is fixed, and the second guide plate is movable relative to the first guide plate to vary the parallelism between the first roller shaft and the second roller shaft.

12. The conveyor according to claim 11, wherein the second guide plate is openably closable with respect to the first guide plate.

13. The conveyor according to claim 10, wherein the hinge shaft has a looseness to vary the position of the second guide plate with respect to the first guide plate.

14. The conveyor according to claim 13, wherein the hinge shaft includes:

a first hinge shaft;

a second hinge shaft; and a third hinge shaft, disposed in an order from an upstream side to a downstream side in the conveyance direction of the target, and each of the first hinge shaft and the third hinge shaft has a long hole to vary the position of the second guide plate with respect to the first guide plate.

15. The conveyor according to claim 14, further comprising a pivot pin through which the one end of the first guide plate and the one end of the second guide plate are coupled in vicinity of the second hinge shaft, and the second guide plate is turnable with respect to the first guide plate about the pivot pin.

16. A conveyor comprising:

a first guide plate including:

a first roller shaft; and a first roller having a first hardness and attached to the first roller shaft; and a second guide plate disposed opposite the first guide plate and including:

a second roller shaft; and a second roller having a second hardness higher than the first hardness of the first roller and attached to the second roller shaft; and a hinge shaft to couple one end of the first guide plate to one end of the second guide plate, wherein parallelism between the first roller shaft and the second roller shaft is variable, the first guide plate and the second guide plate guide a target, the first roller and the second roller nip and convey the target in a conveyance direction, another end of the second guide plate is rotatable with respect to another end of the first guide plate about the hinge shaft, the first guide plate is fixed, the second guide plate is movable relative to the first guide plate to vary the parallelism between the first roller shaft and the second roller shaft, the second guide plate is openably closable with respect to the first guide plate, the hinge shaft is parallel to the conveyance direction, one of said another end of the first guide plate or said another end of the second guide plate has an adjustment plate having an engagement hole, and another of said another end of the first guide plate or said another end of the second guide plate has an engagement pin fit into the engagement hole.

17. The conveyor according to claim 16, wherein the adjustment plate is attachable to said another end of the second guide plate at variable positions to vary the position of the second guide plate with respect to the first guide plate.

18. The conveyor according to claim 17, wherein the hinge shaft has a looseness to vary the position of the second guide plate with respect to the first guide plate.

19. The conveyor according to claim 18, wherein the hinge shaft includes:

a first hinge shaft;

a second hinge shaft; and a third hinge shaft, disposed in an order from an upstream side to a downstream side in the conveyance direction of the target, and each of the first hinge shaft and the third hinge shaft has a long hole to vary the position of the second guide plate with respect to the first guide plate.

20. The conveyor according to claim 19, further comprising a pivot pin through which the one end of the first guide plate and the one end of the second guide plate are coupled in vicinity of the second hinge shaft, and the second guide plate is turnable with respect to the first guide plate about the pivot pin.

* * * * *